US007651010B2

(12) United States Patent
Orzech et al.

(10) Patent No.: US 7,651,010 B2
(45) Date of Patent: Jan. 26, 2010

(54) FOOD DISPENSER WITH PUMP FOR DISPENSING FROM A PLURALITY OF SOURCES

(75) Inventors: Thomas S. Orzech, New Milford, CT (US); Stephen C. Fog, New Canaan, CT (US); Richard L. Murphy, Monbrelloz (CH)

(73) Assignee: Nestec S.A., Vevey (CH)

( * ) Notice: Subject to any disclaimer, the term of this patent is extended or adjusted under 35 U.S.C. 154(b) by 742 days.

(21) Appl. No.: 11/232,962

(22) Filed: Sep. 23, 2005

(65) Prior Publication Data

US 2007/0068969 A1 Mar. 29, 2007

(51) Int. Cl.
*B65D 37/00* (2006.01)

(52) U.S. Cl. ..... 222/214; 222/213; 417/474

(58) Field of Classification Search ..... 222/214, 222/213, 129.1, 129.3, 136–138; 417/475–479
See application file for complete search history.

(56) References Cited

U.S. PATENT DOCUMENTS

| | | | | | |
|---|---|---|---|---|---|
| 3,127,845 | A | * | 4/1964 | Voelcker | 417/478 |
| 3,518,033 | A | * | 6/1970 | Anderson | 417/478 |
| 3,604,418 | A | | 9/1971 | Jones | 128/214 |
| 3,881,641 | A | | 5/1975 | Pliml, Jr. et al. | 222/207 |
| 3,881,846 | A | * | 5/1975 | Kashmerick | 417/478 |
| 4,042,153 | A | * | 8/1977 | Callahan et al. | 222/207 |
| 4,407,436 | A | * | 10/1983 | Broadfoot et al. | 222/636 |
| 4,500,269 | A | | 2/1985 | Jess | 418/45 |
| 4,601,411 | A | | 7/1986 | Van Overbruggen | 222/207 |
| 4,651,898 | A | * | 3/1987 | Bell | 222/129 |
| 4,702,675 | A | * | 10/1987 | Aldrovandi et al. | 417/63 |
| 4,717,047 | A | | 1/1988 | Van Overbruggen | 222/207 |
| 4,967,940 | A | * | 11/1990 | Blette et al. | 222/214 |
| 5,033,943 | A | * | 7/1991 | Durrum et al. | 417/478 |
| 5,105,992 | A | | 4/1992 | Fender et al. | 222/185 |
| 5,118,011 | A | | 6/1992 | Kopp | 222/102 |
| 5,215,215 | A | | 6/1993 | Sauer | 222/1 |
| 5,242,081 | A | * | 9/1993 | van der Heyden et al. | 222/1 |
| 5,255,822 | A | | 10/1993 | Mease et al. | 222/63 |
| 5,316,452 | A | * | 5/1994 | Bogen et al. | 417/412 |
| 5,353,963 | A | | 10/1994 | Gorski et al. | 222/129.1 |
| 5,377,871 | A | | 1/1995 | Banks et al. | 222/41 |

(Continued)

FOREIGN PATENT DOCUMENTS

CA 1 179 992 A 12/1984

(Continued)

OTHER PUBLICATIONS

International Search Report, application No. PCT/EP2006/065533, dated Sep. 13, 2007.

*Primary Examiner*—Lien T Ngo
(74) *Attorney, Agent, or Firm*—Winston & Strawn LLP

(57) ABSTRACT

The present invention relates generally to dispensing system configured for dispensing food product. The device includes a fluid container in fluid communication with a conduit having a compressible portion which is associable with a pumping mechanism for pumping a fluid therethrough. The compression portion contains an upstream uni-directional valve and a downstream uni-directional valve, so that when the compression portion is resiliently compressed, fluid is forced through the downstream valve, and upon decompression, fluid is drawn through the upstream valve. The present invention also relates to a method for dispensing a food product.

25 Claims, 10 Drawing Sheets

U.S. PATENT DOCUMENTS

| | | | | |
|---|---|---|---|---|
| 5,402,913 | A | 4/1995 | Graf | 222/63 |
| 5,452,826 | A | 9/1995 | Stern | 222/207 |
| 5,611,465 | A | 3/1997 | Lee et al. | 222/214 |
| 5,797,519 | A | 8/1998 | Schroeder et al. | 222/129.1 |
| 5,875,930 | A | 3/1999 | Nakajima et al. | 222/129.1 |
| 5,938,414 | A * | 8/1999 | Kayahara et al. | 417/476 |
| 6,003,733 | A | 12/1999 | Wheeler | 222/146.5 |
| 6,016,935 | A | 1/2000 | Huegerich et al. | 222/146.1 |
| 6,056,158 | A | 5/2000 | Rossetti et al. | 222/95 |
| 6,142,340 | A | 11/2000 | Watanabe et al. | 222/66 |
| 6,196,420 | B1 | 3/2001 | Gutierrez et al. | 222/101 |
| 6,283,680 | B1 * | 9/2001 | Vidal | 406/128 |
| 6,454,133 | B1 | 9/2002 | Lopez et al. | 222/102 |
| 6,659,309 | B2 | 12/2003 | Friedman | 222/97 |
| 6,691,894 | B2 | 2/2004 | Chrisman et al. | 222/101 |
| 2004/0129720 | A1 | 7/2004 | Cheng et al. | 222/1 |
| 2006/0249536 | A1 * | 11/2006 | Hartman et al. | 222/129.3 |
| 2007/0000947 | A1 | 1/2007 | Lewis et al. | 222/132 |

FOREIGN PATENT DOCUMENTS

| | | |
|---|---|---|
| EP | 0067466 | 1/1989 |
| WO | WO 02/059035 A2 | 8/2002 |

* cited by examiner

FOOD DISPENSER WITH PUMP FOR DISPENSING FROM A PLURALITY OF SOURCES

FIELD OF THE INVENTION

The present invention relates generally to food dispensing systems. More particularly, the invention relates to food dispensing systems for pumping a fluid from a container.

BACKGROUND OF THE INVENTION

Food dispensing systems have been regularly used in office, restaurant, and convenience store settings. Desirable characteristics of these systems include that the dispensing systems are easy to operate and maintain by the user and provide a hygienic and aesthetically pleasing interface for the user during operation. Some dispensers are adaptable to dispense a variety of food products.

Typical dispensing systems have been found to be lacking in one of these areas. In particular, U.S. Pat. No. 5,452,826 discloses a food dispenser that requires the user to clean parts of the dispenser each time a new food container is loaded within the dispenser. Specifically, after the food container is empty, food product remains in the portioning arrangement and the food product tube. Food product must be cleaned out of these parts in order to avoid contamination with the food product in the new food container, which can be different from the previous food product. Moreover, the dispensing mechanism requires that manual force be applied to the spring-biased lid each time food product is dispensed.

Also, European Patent EP0067466 discloses a food dispenser that is limited to dispensing a food product from a single container. The reference teaches a metering device used to dispense food portions from a food container.

Thus, there is a need for a dispensing system that can be easily loaded with one or more food containers in a reliable and efficient manner that is preferably easy to keep in a hygienic condition.

SUMMARY OF THE INVENTION

A preferred embodiment of the present invention relates to a multiple-fluid sourcing assembly that includes first and second container members containing first and second fluids, respectively. Attached to the first and second container members are first and second conduits in respective fluid communication with the first and second container members to allow the fluids to pass through the conduits. Preferably, the first and second container members are mounted to a mounting member such that the first and second conduits are disposed at a predetermined spacing from each other. A first downstream valve is preferably disposed in the first conduit, downstream of the first compressible portion, and configured to allow the first fluid to flow substantially only downstream out of the first downstream valve. In the preferred embodiment, the first conduit also includes a first compressible portion that is disposed between the first backflow prevention member and the first downstream valve. The first compressible portion is preferably resiliently compressible such that fluid therein is forced downstream through the first downstream valve when the first compressible portion is compressed. The first compressible portion is biased, preferably resiliently, towards an uncompressed state to draw the first fluid into the compressible portion when the first compressible portion is decompressed. The second conduit also includes a second compressible portion that is compressible to pump the second fluid therethrough from the second container member. Preferably, the spacing between the first and second conduits is selected such that both compressible portions are compressible by a pumping mechanism disposed between the two portions.

Preferably, the first and second conduits each have a length of less than about 200 mm. The sourcing assembly further preferably includes a first backflow prevention member disposed in the first conduit and is configured to allow the first fluid to flow only out of the first container. The first compressible portion is preferably between the first backflow prevention member and the first downstream valve such that when the first compressible portion is resiliently biased towards an uncompressed state to draw the first fluid into the first compressible portion, the fluid is forced through the first backflow prevention member.

The sourcing assembly can include a second backflow prevention member disposed in the second conduit that is configured to allow the second fluid to flow substantially only downstream, out from the second container. Additionally, a second downstream valve can be disposed in the second conduit, downstream of the second backflow prevention member, and configured to allow the second fluid to flow substantially only downstream. A second compressible portion is disposed between the second backflow prevention member and the second downstream valve. Preferably, the second compressible portion is resiliently compressible such that fluid therein is forced downstream through the second downstream valve when the second compressible portion is compressed. It is also preferable that the second compressible portion is resiliently biased towards an uncompressed state to draw the second fluid into the second compressible portion through the second backflow prevention member when the second compressible portion is decompressed.

Preferably, the first and second backflow prevention members include respectively, first and second upstream valves. The first and second backflow prevention members can also preferably include, respectively, first and second pinch members configured to pinch the first and second compressible portions to substantially block the backflow of the first and second fluids upstream of the compressible portions. In an alternate embodiment, the first and second conduits, respectively, are free of any upstream valve disposed therein.

Preferably, the spacing between the first and second conduits is selected to enable a single pumping member of the pumping mechanism to concurrently pump both the first and second fluids by compressing the first and second compressible portions. It is also preferable that the first and second conduits are positioned substantially parallel to each other where this spacing is defined.

The first and second conduits preferably include flexible tubing, and the fluids that are dispensed through the conduits are preferably food products. Additionally, the first and second container members can include, respectively, first and second fluid outlet members that are in fluid communication with, respectively, the first and second conduits.

The preferred mounting member of the assembly can include a housing that houses both the first and second container members. Preferably, the mounting member includes a rigid member, such as a plate, that connects the first outlet member and the second outlet member. The rigid plate member also preferably maintains the predetermined spacing between the first and second conduits.

The preferred embodiment also includes a pumping mechanism. Preferably, the pumping mechanism has a pumping member that is disposed between the first and second compressible portions of the sourcing assembly. The pumping mechanism can also be preferably configured for acting against both the first and second compressible portions to alternatingly compress and decompress the compressible portions to pump both the first and second fluids through the conduits.

A conduit guide can preferably be configured for guiding the conduits for placement of the compressible portions in pumpable association with the pumping mechanism. Preferably, the conduit guide defines an upstream opening configured to facilitate reception therein of the conduits. The upstream opening is preferably larger than at least a portion of the conduit guide disposed downstream of the upstream opening to position the conduits in the pumpable association.

The preferred embodiment includes first and second compression members that are disposed adjacent the pumping member, preferably on opposite sides thereof, to define first and second pumping spaces between the pumping member and the compression members. Preferably, the first and second compressible portions can be placed in the first and second pumping spaces, respectively, in the pumpable association. The pumping member can be configured to then compress the compressible portions against the compression members to pump the first and second fluids from the respective container members.

The compression members and pumping member are preferably movable relative to each other to change the size of the pumping spaces. Preferably, the pumping member is movable relative to the first compression member in at least one rotational position to insert the fluid conduit into the first pumping space regardless of the position of the pumping member. The dispensing system can also include a pump-member control that is configured for stopping the pumping member in a stopped position to preferably maintain a sufficient clearance in the pumping spaces for generally unimpeded reception of the fluid conduits therein. Preferably, the pumping member can be rotatable and have at least one pump portion configured to alternatingly and compressingly move towards the first and second compressible portions.

In embodiments in which the dispensing system is a beverage dispenser, the first and second fluid sources can be beverage components. Preferably, the beverage dispenser can be configured for mixing the components to prepare and dispense a beverage. The beverage dispenser can also include a fluid mixing collector that is disposed below the beverage components to receive and then mix the components.

In a preferred method, a fluid can be simultaneously dispensed from multiple sources. Preferably, the method includes reciprocating a pump portion of a pumping member alternatingly against first and second compressible conduit portions to alternatingly compress and decompress the compressible conduit portions. In this manner, decompressing the compressible conduit portions draws in fluids through backflow prevention members that are in fluid communication with the compressible conduit portions and causes downstream valves that are also in fluid communication with the compressible conduit portions to close. Similarly, compressing the compressible conduit portions forces the fluid through the downstream valves and causes the backflow prevention members to close.

A pumping assembly of one embodiment includes a fluid conduit comprising a compressible portion, and a valve disposed in the fluid conduit downstream of the compressible portion and configured to allow a fluid to flow substantially only downstream of the compressible portion. The pumping assembly also includes a pump mechanism that includes a pinch member disposed adjacent a pumping space and configured to be moved by the pumping mechanism to pinch the compressible portion of the fluid conduit to block the backflow of the fluid upstream of the compressible portion, and a pumping member disposed adjacent the pumping space and configured to be moved by the pumping mechanism to compress and decompress the compressible portion of the fluid conduit to pump the fluid therethrough. Also included is a controller configured for sequentially coordinating the movement of the pinch member and the pumping member. Preferably, the pump mechanism includes a linear actuator.

The present invention thus enables a user to easily load a dispensing system in a hygienic manner and readily pump one or more fluids from fluid containers, such as to dispense a beverage.

DETAILED DESCRIPTION OF THE PREFERRED EMBODIMENTS

Figure 1:
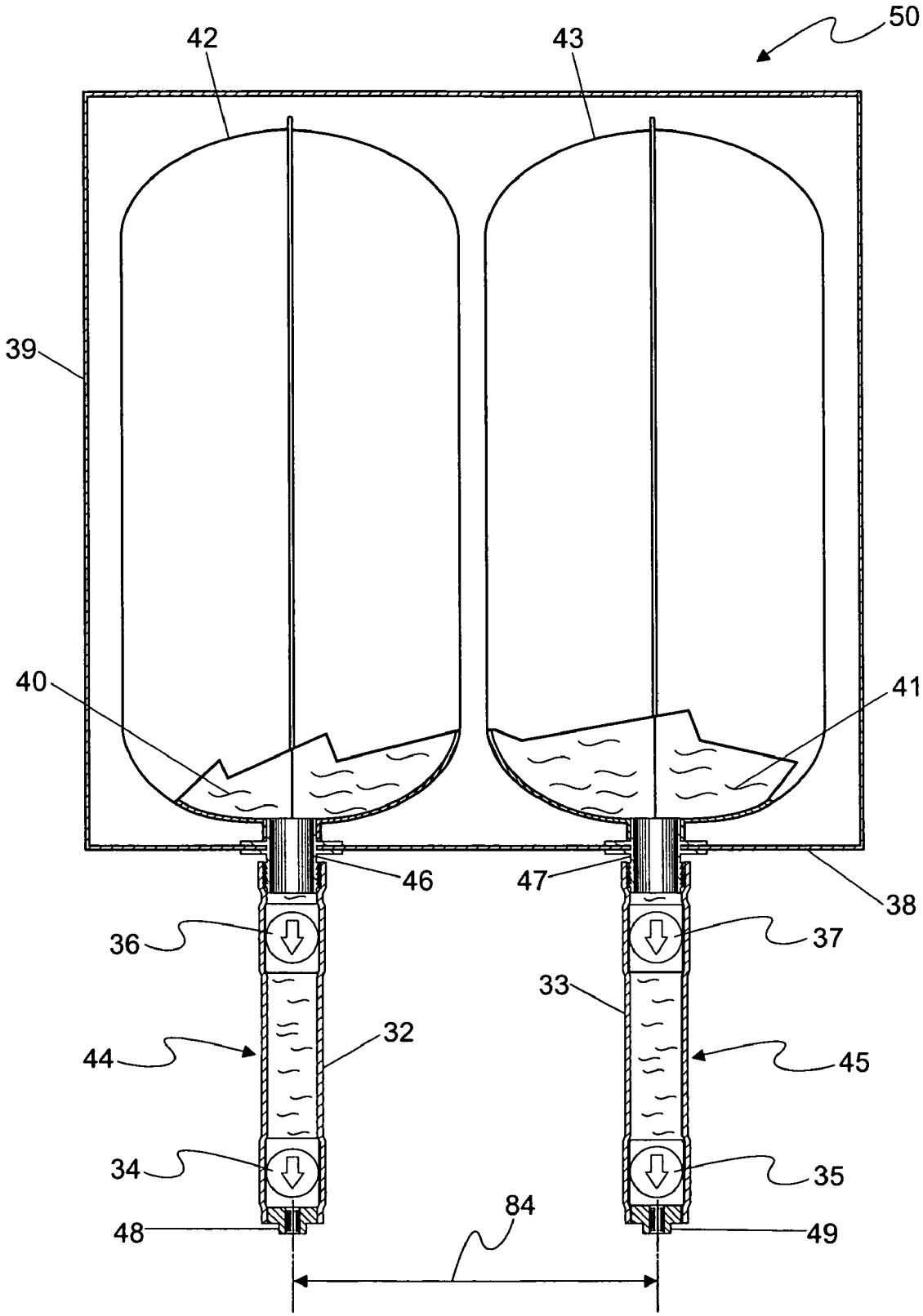
FIG. 1 is a front cut-away view of one embodiment of the multiple-fluid sourcing assembly.
Figure 2:
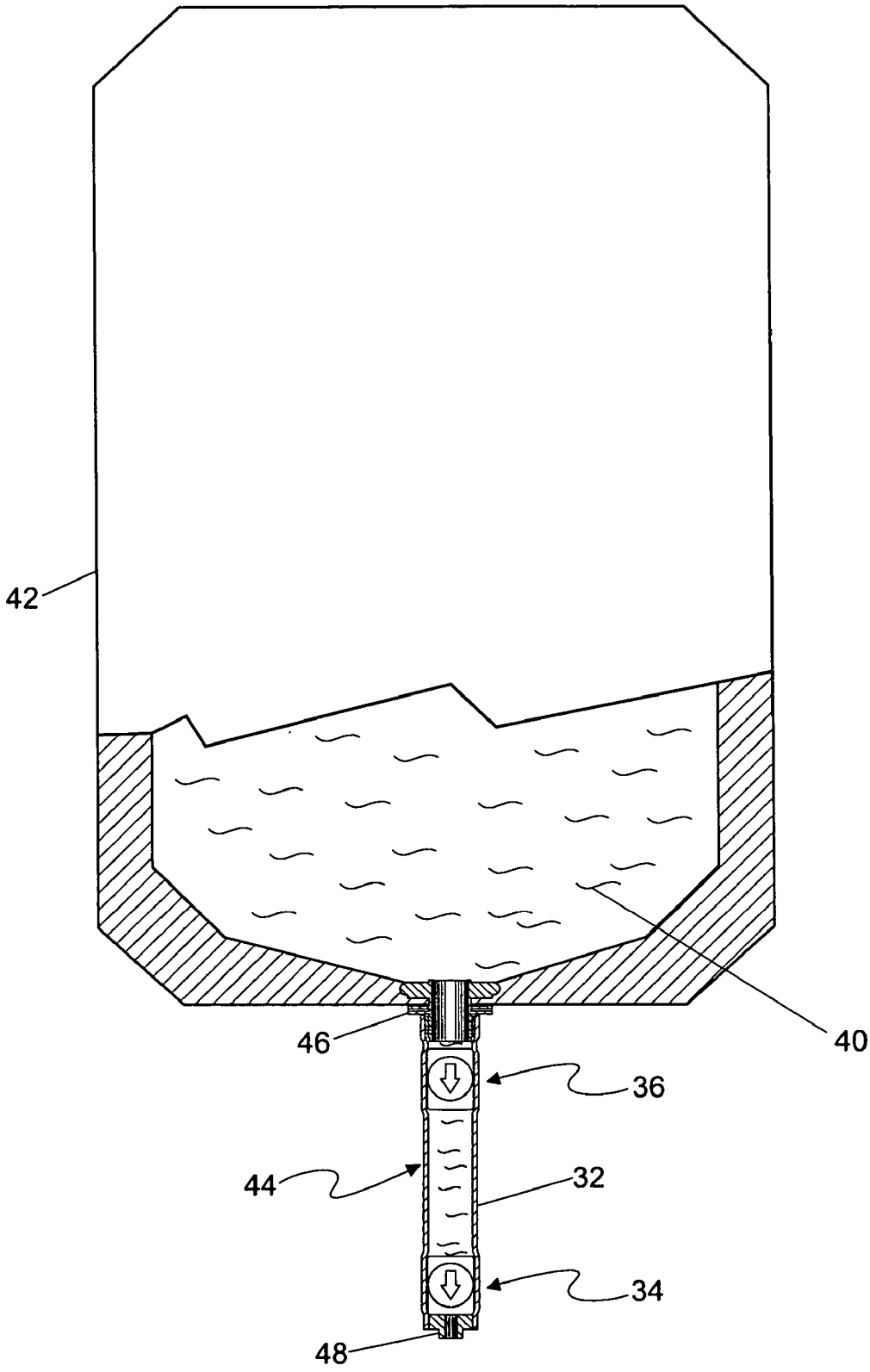
FIG. 2 is a side cut-away view of a first container/conduit assembly thereof.

Referring to FIGS. 1 and 2, a preferred embodiment of the present invention is a multiple-fluid sourcing assembly 50 that includes first and second container members 42,43. Preferably, the container members 42,43 are of bag-in-box construction, although other configurations can be used. The first and second container members 42,43 contain, respectively, first and second fluids 40,41 for dispensing. In one embodiment of the assembly, the fluids preferably include food products, and more preferably beverage components that can be mixed with each other, or with another fluid to produce a beverage. Alternatively, ready-to-dispense food products may be used.

The preferred beverage is any beverage, hot or cold, that can be prepared from at least one concentrate, such as a syrup, a coffee concentrate, a cocoa concentrate, a milk concentrate, a tea concentrate, a juice concentrate, or a combination thereof. The concentrate is preferably mixed with a liquid, such as water, to produce the beverage suitable for consumption, such as a soft drink, a coffee drink, a tea drink, a juice, or a milk-based drink. Preferably, the beverages or beverage components include fluid concentrates. More preferably, the fluid concentrates include coffee or chocolate. In one embodiment, a coffee fluid-concentrate is used, which can include, for example, coffee solids, coffee aroma, and/or a whitener or dairy product.

Preferably, first and second conduits 44,45 are associated with the first and second container members 42,43 so that the respective conduits 44,45 are in fluid communication with the first and second container members 42,43. Preferably, the conduits 44,45 are made of flexible tubing and have first and second nozzles 48,49 at the ends thereof. Additionally, first and second fluid outlet members 46,47 are preferably disposed, respectively, at the bottom of the first and second container members 42,43 and are in fluid communication therewith and with the first and second conduits 44,45.

The sourcing assembly 50 also includes a mounting member 38 to which the first and second container members 42,43 are mounted. The mounting member 38 preferably includes a housing 39, as shown in FIG. 1, that is configured to house the first and second container members 42,43 therein. Preferably, the container members 42,43 are mounted such that the respective conduits 44,45 are disposed at a predetermined spacing 84 from each other. The predetermined spacing 84 is preferably dependent on the volume that the first and second container members 42,43 occupy. Preferably, the predetermined spacing 84 is at least about 30 mm and is at most about 100 mm. More preferably, the predetermined spacing 84 is about 50 mm to 70 mm. The conduits 44,45 are preferably positioned substantially parallel to each other to leave the spacing of predetermined value 84 therebetween. In this manner, the predetermined spacing 84 between the conduits 44,45 can be sufficiently matched to a predetermined spacing of a conduit guide to facilitate alignment as the sourcing assembly 50 is loaded onto a pumping assembly. Alternatively, the conduits 44,45 can be disposed non-parallel with respect to each other.

The mounting member 38 also includes a rigid plate member, which can be of unitary construction with the housing 39 or a separate piece associated with the housing 39. The rigid plate member is preferably configured to connect the first and second fluid outlet members 46,47, which advantageously provides additional support to maintain the conduits 44,45 at the predetermined spacing 84 from each other. Preferably, the plate member can be made of a rigid or semi-rigid material. Preferably, the material of the mounting member 38 includes a cardboard or plastic material, and the housing and rigid late member can be of unitary construction.

The preferred embodiment of the first container member 42 and the associated fluid outlet member 46 and conduit 44 are shown in FIG. 2. The second container member 43, and the associated fluid outlet member 47 and conduit 45 are preferably of a similar configuration. The conduit 44 can be shorter than conduits generally used for food dispensers that include peristaltic pumps, since these typically require a sufficient length of tubing to wrap around the inside of a peristaltic-pump stator. The present arrangement can thus significantly reduce the amount of tubing that is required to dispense fluid, in some cases by over 45 inches as compared to typical peristaltic systems.

Preferably, the container member 42, fluid outlet member 46, and conduit 44 are configured as a closed system that preferably is prepackaged as a single manipulatable structure, as shown in FIG. 2. More preferably, the sourcing assembly 50 comes prepackaged and includes the first and second container members 42,43 mounted to the mounting member 38 and contained in the housing 39. This advantageously prevents or reduces the risk of contamination of the fluids 40,41 in the container members 42,43 and contamination of the internal workings of the dispenser. Moreover, the container member 42 and associated conduit 44, or the sourcing assembly 50, can preferably be entirely disposable upon completion of dispensing, which avoids having to flush fluid remnants from the internal tubing of the dispenser as is typically required in previous food dispensers.

Figure 3:
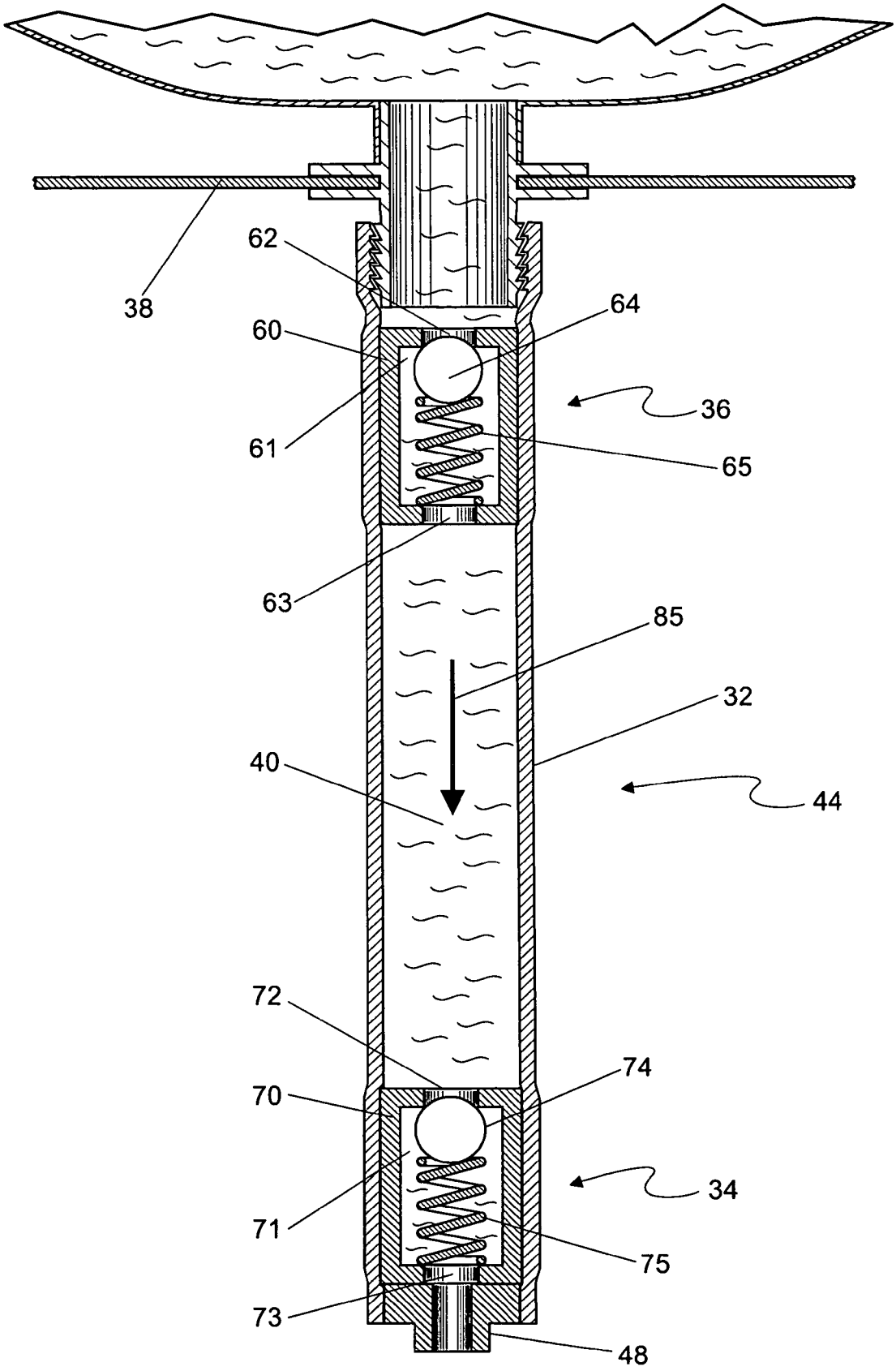
FIG. 3 is a front cross-sectional view of a first conduit thereof.

Referring to FIGS. 1 and 3, the first and second conduits 44,45 preferably include, respectively, first and second backflow prevention members, which are preferably first and second upstream valves 36,37, and first and second downstream valves 34,35. The first and second conduits 44,45 are each preferably at least about 50 mm and more preferably at least about 80 mm in length, and are each preferably at most about 250 mm and more preferably at most about 200 mm in length. Disposed between the two valves, respectively, are first and second compressible portion 32,33 that are configured for association with a pumping mechanism. Preferably, the compressible portions 32,33 are made of a resilient flexible tubing and have axial lengths of at least about 1 inch and at most about 5 inches. More preferably the axial lengths of the compressible portions 32,33 is about 1.5 inches to about 3 inches. Preferably, the compressible portions 32,33 have an outside diameter of about 5 to 20 mm. More preferably, the compressible portions 32,33 have an outside diameter of about 10 to 15 mm. In one embodiment, the outside diameter is about 13 mm. The first and second nozzles 48,49 are respectively disposed downstream of the downstream valves 34,35.

The upstream valves 36,37 and downstream valves 34,35 are preferably disposed within their respective compressible portion 32,33 and configured to permit and impede the flow of fluid therethrough. Preferably, the first and second upstream valves 36,37 and the first and second downstream valves 34,35 are uni-directional valves that allow uni-directional flow of fluids 40,41 substantially only in a downstream direction 85 out of the container members 42,43. In the preferred embodiment, the valves 34,35,36,37 are check valves, such as spring-loaded, ball, check valves, as shown in FIG. 3. The valves 34,35,36,37 are configured to advantageously provide an accurate dosing of fluid upon compression of the compressible portions 32,33. Referring to the first conduit 44, for example, the first upstream and downstream check valves 36,34 each include annular members 60,70 that each define inner cavities 61,71 of each valve 36,34. Upstream openings 62,72 and downstream openings 63,73 of each valve 36,34 allow the first fluid 40 to pass through the cavities 61,71 of each valve 36,34.

Also preferably disposed within each cavity 61,71 are ball members 64,74 adjacent the respective upstream openings 62,72. The ball members 64,74 are each biased by a resilient member 65,75 towards a closed position to block the respective upstream openings 62,72 and impede the flow of the first fluid 40 therethrough.

As the compressible portion 32 is compressed, the pressure therein is increased to greater than atmospheric pressure. This positive pressure exerts a force on the downstream ball member 74 of the downstream valve 34, which causes the associated resilient member 75 to compress. As the resilient member 75 compresses, the ball member 74 moves in the downstream direction 85 and allows the first fluid 40 to enter the cavity 71 through the upstream opening 72 and exit through the downstream opening 73, and eventually exit the first conduit 44 through the nozzle 48. The increased pressure in the compressible portion 32 also exerts a positive force on the upstream ball member 64 of the upstream valve 36, which, along with the resilient member 65, causes the upstream ball member 64 to bias towards the closed position to block the upstream opening 62 and impede the flow of the first fluid 40 therethrough.

Upon decompression of the compressible portion 32, the pressure therein is reduced below atmospheric pressure, and this negative pressure and the resilient member 75 of the downstream valve 34 is able to bias the ball member 74 back against the upstream opening 72 to impede the flow of the first fluid 40 therethrough. With respect to the upstream valve 36, decompression of the compressible portion 32 creates a negative pressure which acts on the upstream ball member 64 and causes the associated resilient member 65 to compress. As the resilient member 65 compresses, the ball member 64 moves in the downstream direction 85 and allows the first fluid 40 from the first container member 42 to enter the cavity 61 through the upstream opening 62 and exit through the downstream opening 63 into the compressible portion 32. Advantageously, the act of compressing and decompressing the resilient compressible portion 32, together with the opening and closing of the upstream and downstream valves 36,34, allow the first fluid 40 to flow in substantially only the downstream direction 85 through the first conduit 44. While the compression and decompression of only the first compressible portion 32 has been described herein, the second compressible portion 33, and its associated upstream and downstream valves 37,35, are configured to act in the same manner.

Preferably, the spring-loaded, ball, check valves are about 40 to 60 mm in length, with an outside diameter of about 5 to 20 mm, and can cause local stretching of the conduit where placed. More preferably, the length of the check valves is about 45 to 55 mm, with an outside diameter of about 10 to 15 mm. Even more preferably, the length of the check valves is about 52 mm, with an outside diameter of about 13 mm. In other embodiments, the valves are molded of a thermoplastic material, and can be other types of valves, for example flapper valves. The valves can also be molded in the conduits as one piece.

Alternatively, the first and second conduits can preferably include, respectively, only first and second compressible portions therein and first and second downstream valves disposed downstream thereof, with no upstream valves or backflow prevention members disposed between the compressible portions and the containers. Thus, when the first and second compressible portions are resiliently compressed, the first and second fluids therein are forced, respectively, downstream through the first and second downstream valves, and when the first and second compressible portions are decompressed, the first and second fluids, respectively, are drawn into the first and second compressible portions.

Figure 4:
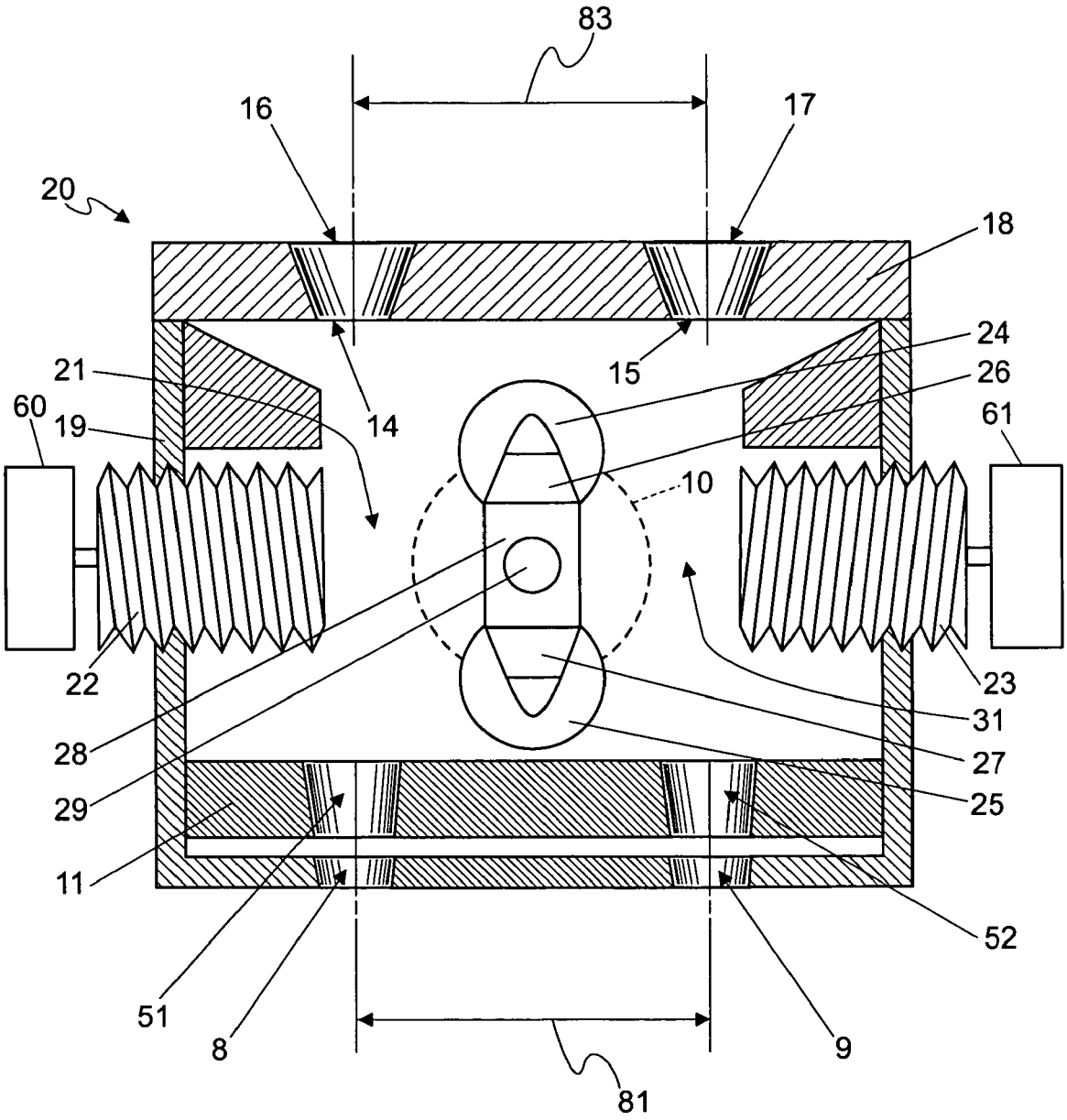
FIG. 4 is a front cross-sectional view of an embodiment of a pumping assembly, with the pumping member in a loading position.
Figure 5:
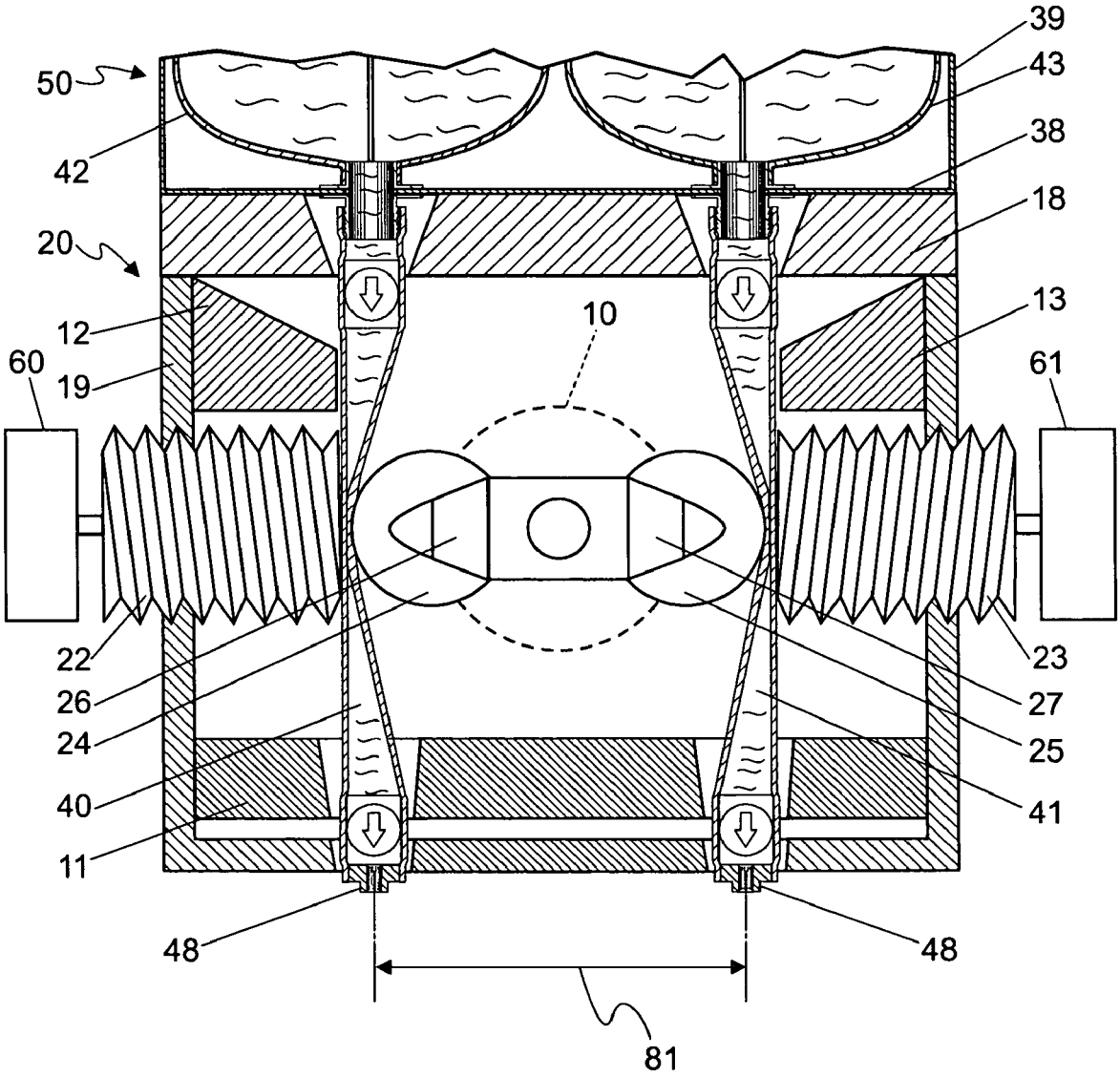
FIG. 5 is a front cross-sectional view thereof, with the pumping member in a compressing position.

To facilitate downstream flow of fluids 40,41 out of the container members 42,43 and through the conduits 44,45, the sourcing assembly 50 can be brought toward a pumping assembly 20 such that the conduits 44,45 of the sourcing assembly 50 are disposed in respective first and second pumping spaces 21,31 as shown in FIGS. 4 and 5. The pump assembly 20 includes a pump housing 19. Preferably, the pump housing 19 is made of any suitable material such as a metal or plastic. The pump housing 19 is configured to allow for a stable and easy connection between the sourcing assembly 50 and the pumping assembly 20. The pump housing 19 preferably includes a conduit guide, which includes an upper conduit guide 18 that is configured for guiding the conduits 44,45 for placement of the compressible portions 32,33 in pumpable association with a pumping member 28 of a pumping mechanism in the respective pumping spaces 21,31.

In the preferred embodiment, the upper conduit guide 18 is configured for closely and stablely supporting the mounting member 38. Preferably, the upper conduit guide 18 includes guide openings to receive conduits 44,45 therein. More preferably, the guide openings include first and second upstream openings 16,17 configured to facilitate reception therein of the first and second conduits 44,45. The upstream openings 16,17 are preferably wider than the diameter of the conduits 44,45 to guide the conduits through the guide openings so that loading of the sourcing assembly is simple and easy. Preferably, the upstream openings 16,17 have a diameter of about 10 to 30 mm. More preferably, the diameter is about 15 to 25 mm. Even more preferably, the diameter is about 20 mm. The guide openings also preferably include first and second downstream openings 14,15, which are preferably narrower than the upstream openings 16,17, but slightly wider than the diameter of the conduits 44,45 to allow the receipt of the conduits therethrough. Preferably, the downstream openings 14,15 have a diameter of about 10 to 20 mm. More preferably, the diameter is about 12 to 16 mm. Even more preferably, the diameter is about 14 mm. The guide openings are disposed from each other at a predetermined spacing 83, which matches the predetermined spacing 84, such that the conduits 44,45 are aligned in pumpable association with the pumping member 28 of the pumping mechanism. Preferably, the guide openings are conical or have another shape configured to guide the conduits 44,45 to fall directly in pumpable association with the pumping member 28 of the pumping mechanism.

Advantageously, the upper conduit guide 18 allows for the easy and intuitive loading and unloading of the sourcing assembly 50 from the pumping assembly 20. During loading of the sourcing assembly 50, the user can "drop and load" the conduits 44,45 into the pumping spaces 21,31 by loosely aligning the conduits 44,45 with the relatively wider upstream openings 16,17 of the upper conduit guide 18 and lowering or dropping the sourcing assembly 50 onto the pump assembly 20 to maintain a stable connection between the mounting member 38 and the upper conduit guide 18.

In the preferred embodiment, the conduit guide also includes intermediate guide members 12,13 that are disposed respectively on the right and left walls of the housing 19 above the compression members 22,23. Preferably, the intermediate guide members 12,13 are configured for preventing lateral movement of the conduits 44,45 upon insertion into the pumping spaces 21,31, thus maintaining the conduits 44,45 in a substantially parallel alignment with each other at the predetermined spacing 83. The conduit guide also includes a lower guide member 11, disposed below the compression members 22,23, with openings 51,52 for maintaining the conduits 44,45 in a substantially parallel alignment with each other at a predetermined spacing 81, which preferably matches the predetermined spacings 83,84. The pump housing 19 preferably includes first and second exit openings 8,9 configured to allow fluids 40,41 to exit the pumping assembly 20 through the nozzles 48,49.

Preferably, the mounting member 38 is associated with the upper conduit guide 18 such that the first and second compressible portions 32,33 of the conduits 44,45 are compressible by the pumping member 28. The pumping member 28 is preferably rotatably mounted within the pump housing 19 over a pump shaft 29. The pumping member 28 preferably includes at least one arm 26 on which is attached one or more pump portion 24. Preferably, the pumping member 28 is configured such that its pump portion 24 can alternatingly and compressingly engage the first and second compressible portions 32,33 to pump the first and second fluids 40,41 therethrough. In the preferred embodiment, as shown in FIGS. 4 and 5, the pumping member 28 includes two arms 26,27 on which are attached two pump portions 24,25. In this embodiment, the pump portions 24,25 are rollers that are rotatable as they compress the compressible portions 32,33. Alternatively, the pumping member 28 includes two arms 26,27 that are configured to slide over and compress the compressible portions 32,33 to pump fluids therethrough. Preferably, the arms 26,27 are disposed about 180° from each other such that the compressible portions 32,33 can be engaged by the pump portions 24,25 concurrently as the pumping member 28 rotates about the fixing member 29. Alternatively, the arms 26,27 can be disposed at other angles from each other to vary the time between compressions of the compressible portions as desired.

The preferred embodiment also includes a pump motor 10 that is configured for rotating the pumping member 28. Preferably, the rate of rotation can be adjusted such that when pumping member 28 is set to a high rate of rotation, more fluid 40,41 can be pumped through the conduits 44,45. Additionally, the pump motor 10 can preferably stop the pumping mechanism such that the pumping member 28 is stopped in a loading position as shown in FIG. 4. Advantageously, stopping the pumping member 28 in the loading position maintains a sufficient clearance in the pumping spaces 21,31 to allow loading and extraction of the fluid conduits 44,45, preferably in a generally unimpeded manner, in and out from the pumping assembly 20 for easy loading and unloading of the sourcing assembly 50 thereon.

The preferred embodiment also includes first and second compression members 22,23 that are disposed in the walls of the pump housing 19, preferably substantially on opposite sides of the pumping member 28, and adjustably extend laterally to define the first and second pumping spaces 21,31. Preferably, the pumping member 28 is movable relative to the compression members 22,23 in at least one rotational position for insertion of the fluid conduits 44,45 in to the respective pumping spaces 21,31. The compression members 22,23 and the pump portions 24,25 are preferably adjustable relative to each other to change the size of the first and second pumping spaces 21,31. Preferably, the compression members 22,23 are threaded such that they are movable in the direction generally transverse to the axes of the compressible portions 32,33 and to the flow of fluids by. This can be achieved with threaded compression members 22,23, as shown in FIGS. 4 and 5, that can be screwed into and out of the pump housing 19. Additionally, the compression members 22,23 are preferably independently and automatically adjustable in the lateral direction by compression member motors 60, 61. Alternatively, the compression members 22,23 are independently and automatically adjustable by a single compression member motor. In another embodiment, the compression members 22,23 can be adjusted manually.

Referring to FIG. 5, the first and second compressible portions 32,33 can be placed in the first and second pumping spaces 21,31 in pumpable association with the pumping member 28. When the pumping member 28 rotates, the pump portions 24,25 can preferably alternatingly compress and decompress the first and second compressible portions 32,33 against the respective compression members 22,23 to pump the first and second fluids 40,41 from the container members 42,43. By using the pump portions 24,25 to compress the compressible portions 32,33 against the compression members 22,23, the dispenser can advantageously dispense an accurate and consistent amount of fluid 40,41 each time the compressible portions 32,33 are compressed. The dispenser can be set up to dispense a variety of fluids, including, for example, food products with higher viscosities or suspended solids. Specifically, the dispenser is advantageously able to dispense fluids having a viscosities of about 1 to about 3500 cp. More preferably, the dispenser can dispense fluids with viscosities of about 100 to about 2000 cp.

Moreover, the amount of first fluid 40 that is dispensed from the first conduit 44, for example, can be varied independent of the amount of second fluid 41 that is dispensed from the second conduit 45 by separately moving each compression member 22,23 in or out of its respective pumping space 21,31. For example, the more that the first compression member 22 is moved into the first pumping space 21, the more that the first compressible portion 32 will be compressed by the pump portions 22,23 and thus the more that first fluid 40 will be dispensed from the first conduit 44. Importantly, the compression members 22,23 can be moved independent of each other which allows the user to separately control the amount of fluid 40,41 that is dispensed from each conduit 44,45 for preparing beverages that require different proportions of each fluid. The amounts of each fluid that are dispensed can also be adjusted to provide beverages that are contained in containers of different volumetric size.

The preferred embodiment also includes a motor controller that controls the pump motor 10 and the compression member motors 60,61. Preferably, the motor controller receives input from the user as to the type and size of beverage desired, and controls or adjusts the pump motor 10 and the compression member motors 60,61 accordingly to vary the amounts of first and second fluids 40,41 that are dispensed.

Figure 6:
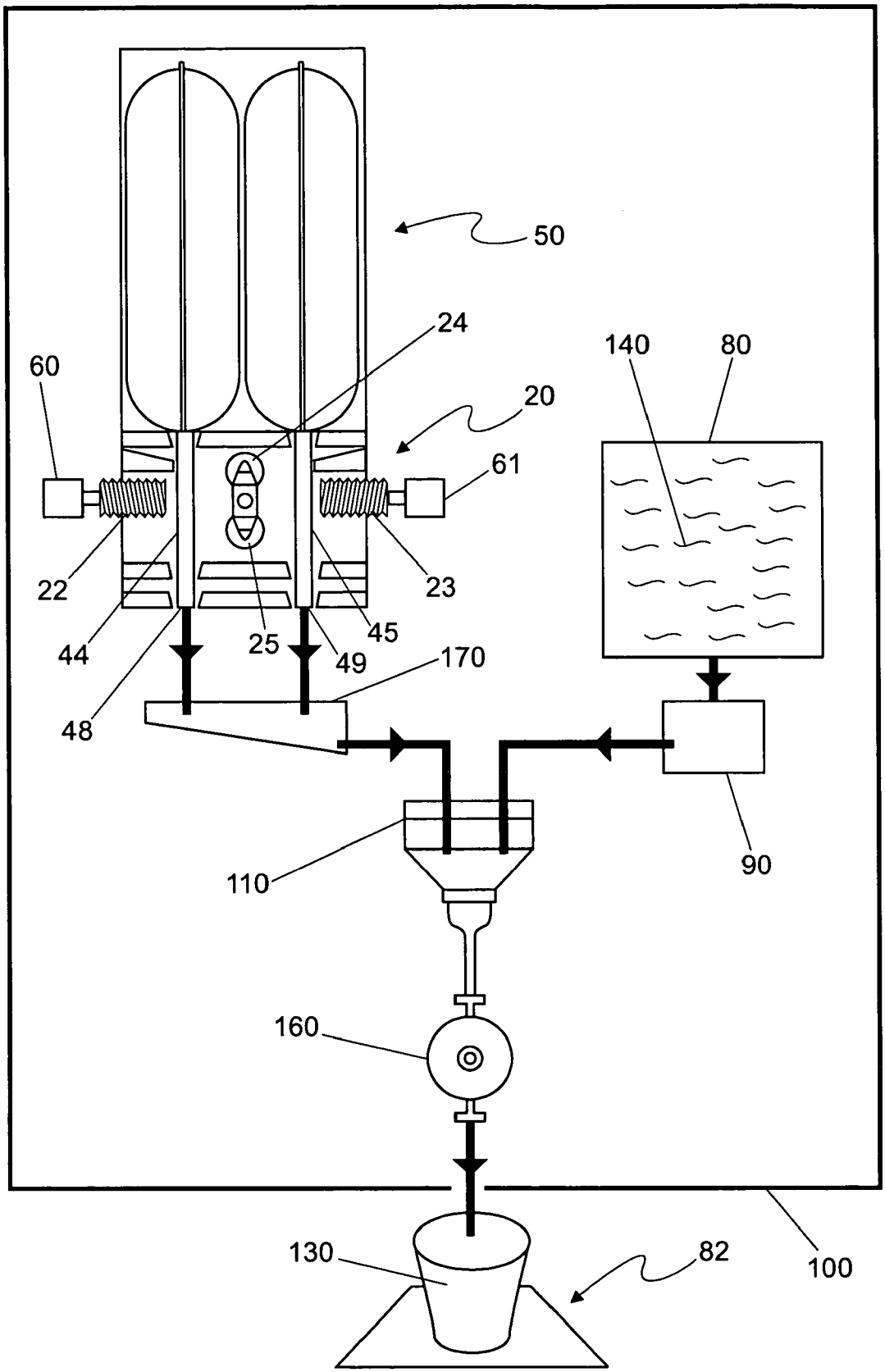
FIG. 6 is a schematic view of an embodiment of a food dispenser.
Figure 7:
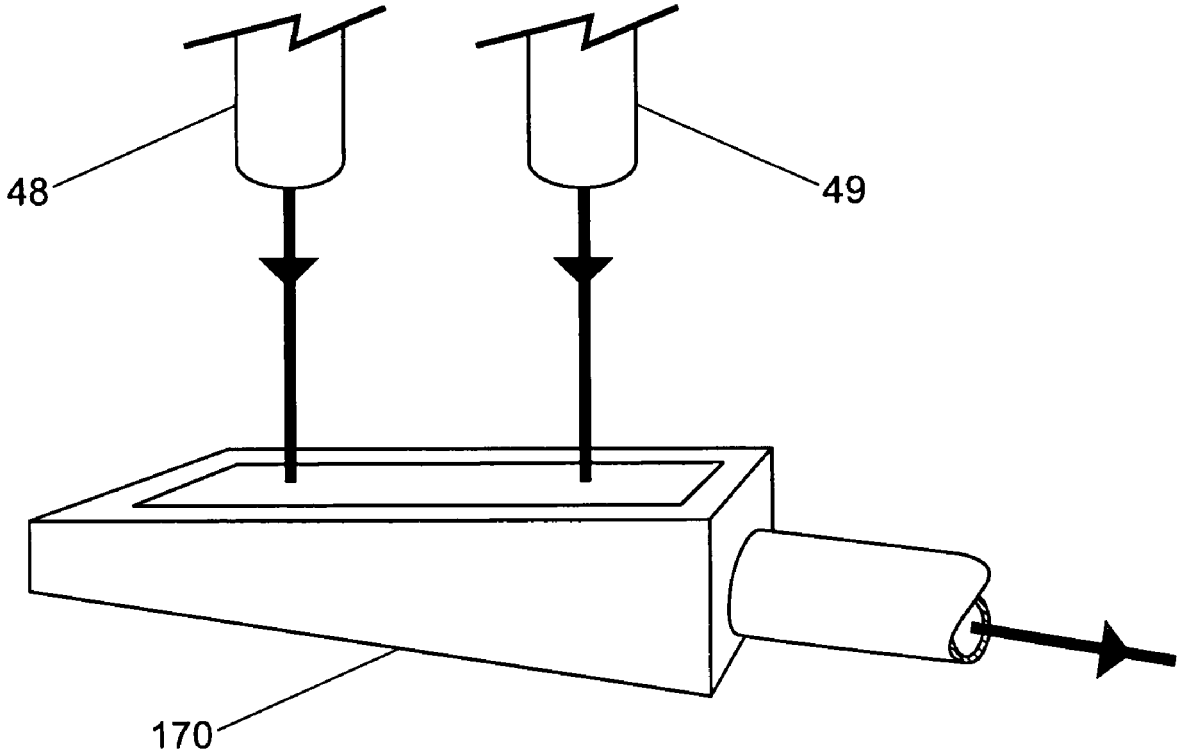
FIG. 7 is a front perspective view of an embodiment of a fluid mixing collector.

FIG. 6 shows one embodiment of the invention that includes a beverage dispenser having a dispenser housing 100 that preferably contains a fluid mixing collector 170 that collects the beverage components as they exit the pumping assembly 20. The beverage dispenser also includes a multiple fluid-sourcing assembly 50 that is associated with a pumping assembly 20 as previously described. Preferably, the fluid mixing collector 170 is disposed below the nozzles 48,49 of the first and second conduits 44,45 to receive and mix the beverage components therein. The fluid mixing collector 170 preferably has an inclined bottom panel, as shown in FIG. 7, that allows the mixed beverage components to easily exit the collector. Preferably, the beverage dispenser also includes a mixer 110 that receives the mixed beverage components from the fluid mixing collector 170.

The beverage dispenser also preferably includes a liquid supply 80 that can be associated with a pump 90. Preferably the liquid supply supplies water or another liquid 140 to dilute or mix the beverage components. The liquid 140 from the liquid supply 80 is preferably dispensed into the mixer 110 for mixing with the beverage components to prepare a beverage. The beverage is then be dispensed from the mixer 110, preferably passing through a whipper 120, and then into a serving container 130 received at a serving location 82. In one embodiment, the mixer 110 includes a heating or refrigeration element to heat or cool the mix of beverage components and liquid supply before dispensing.

Figure 8:
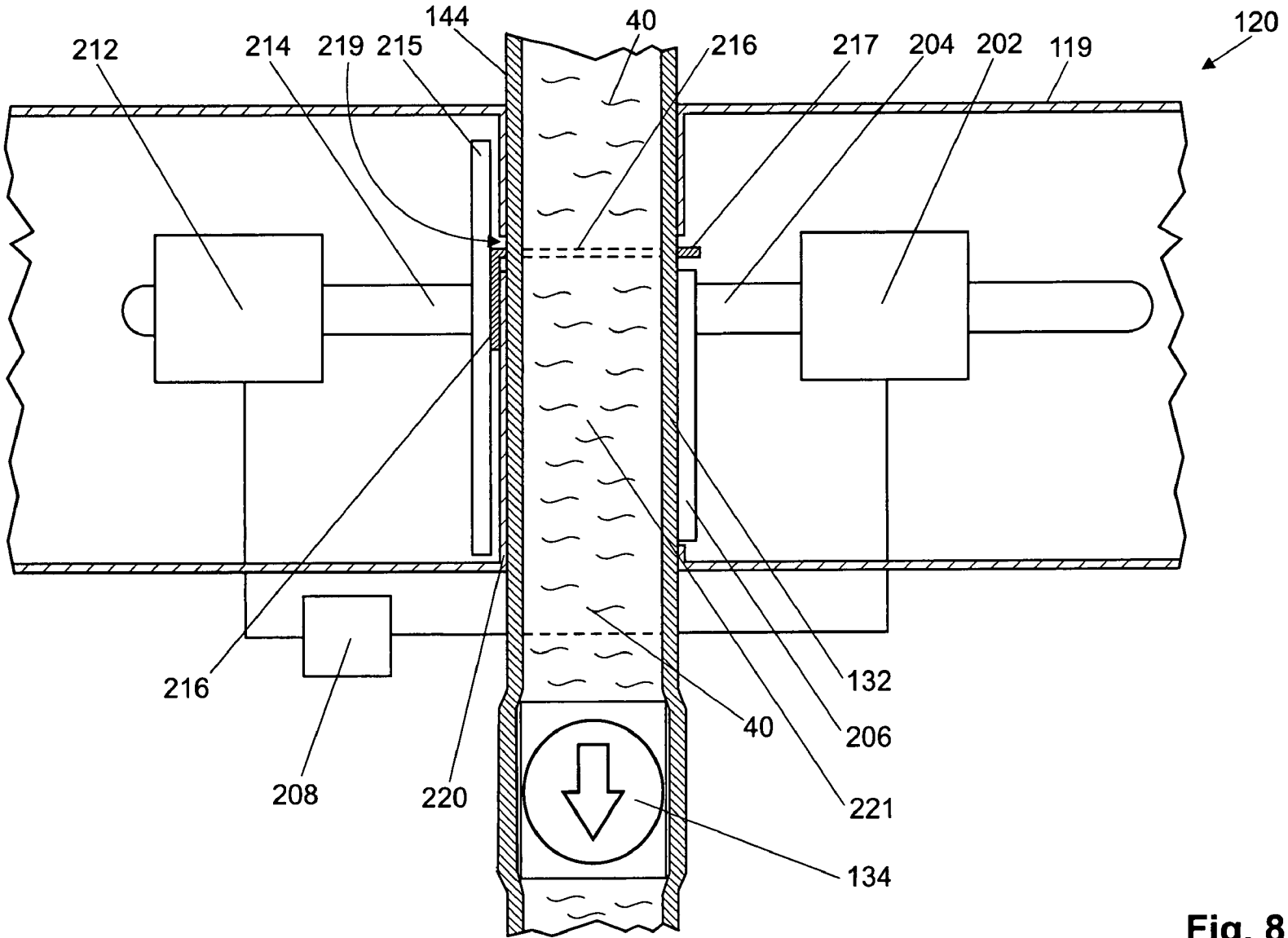
FIG. 8 is a front cross-sectional view of an embodiment of a pumping assembly in the loading position, using a linear actuator.
Figure 9:
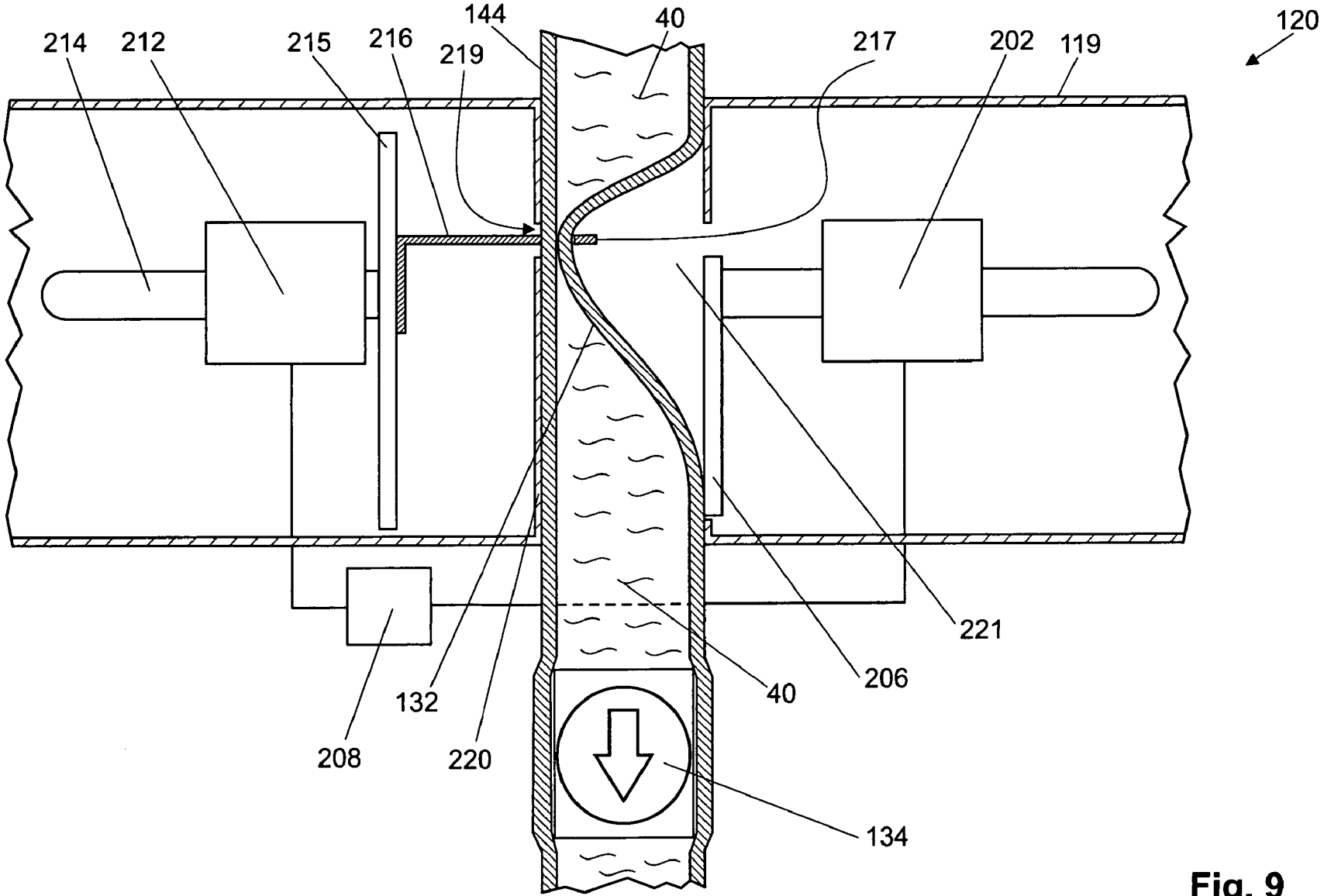
FIG. 9 is a front cross-sectional view of the pumping assembly thereof with a pinch member in the pumping position.
Figure 10:
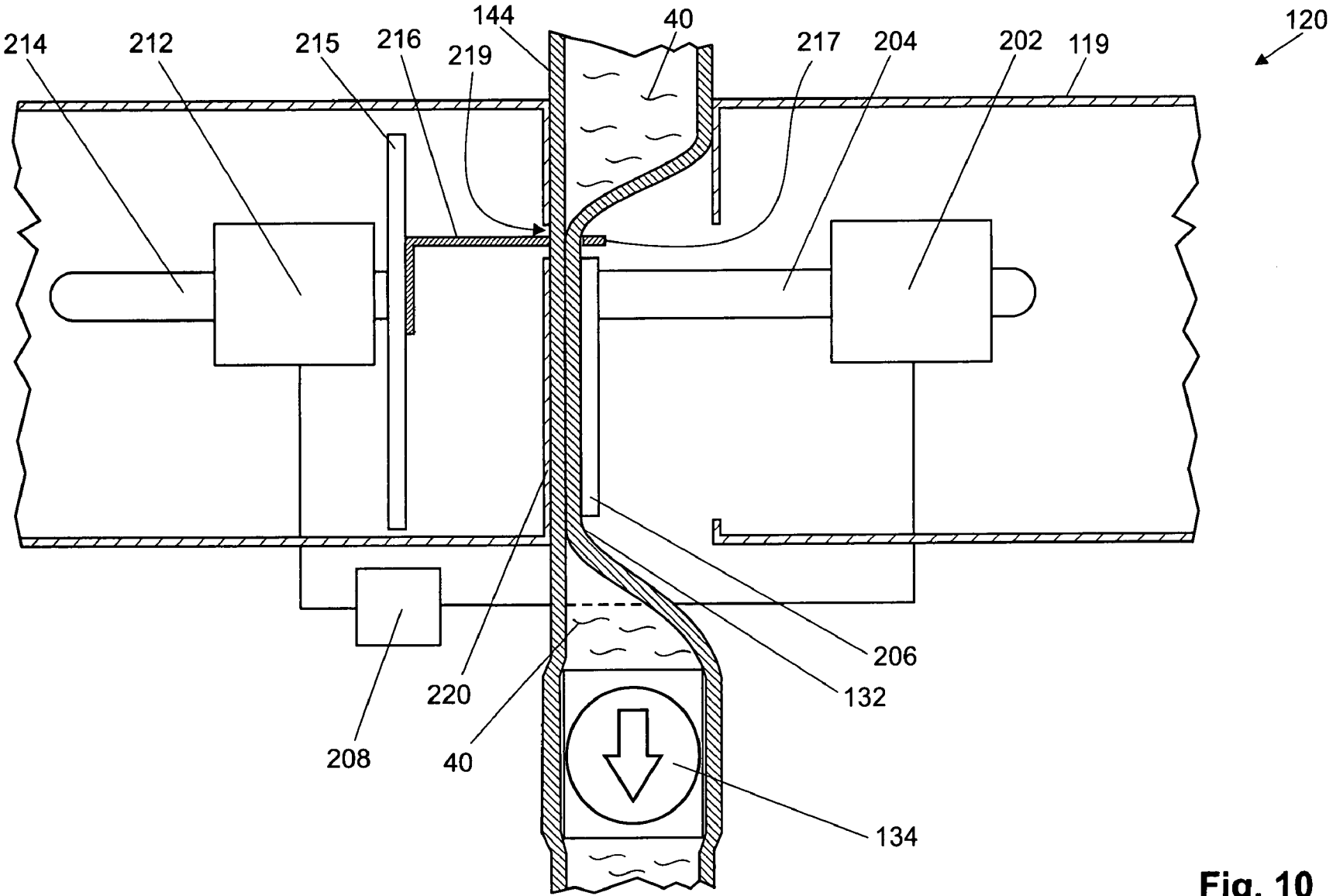
FIG. 10 is a front cross-sectional view thereof with a pumping member in the pumping position.

Another preferred embodiment of a pumping assembly 120 of the present invention is shown in FIGS. 8-10. In this embodiment, the container housing and the first and second container members contained therein, as previously described, are associated with the pump housing 119. The pump housing 119 preferably includes a first pumping space 221 that is configured for receiving therein a first compressible portion 132 of a first conduit 144. The first conduit 144 preferably includes a first valve 134 that is disposed downstream of the first compressible portion 132. The first valve 134 is preferably a uni-directional valve, as previously described. Preferably, the pump housing also includes a second pumping space that is configured for receiving therein a second compressible portion of a second conduit.

A first pumping mechanism of the pumping assembly 120 preferably includes a first linear actuator that is associated with the first pumping member 206 and the first pinch member 216 to move the first pumping member 206 and first pinch member 216 between loading and pumping positions. In the preferred embodiment, the first linear actuator preferably includes a first pinch solenoid 212 and a first pump solenoid 202. In other embodiments, the first pumping mechanism includes pneumatic or hydraulic mechanisms, or non-linear actuators or motors, for moving the first pumping member and first pinch member in the loading and pumping positions.

The first pinch solenoid 212 is preferably associated with a first pinch member 216 that is configured for pinching the first compressible portion 132 to close off, preferably substantially, the lumen therein to prevent the backflow of the first fluid 40 during pumping. In one embodiment, the first pinch solenoid 212 is disposed opposite the first pump solenoid 202 with respect to the first compressible portion 132. The first pinch solenoid 212 is preferably associated with a first pinch member axle 214, at the end of which is disposed a first pinch disc 215. The first pinch member 216 preferably extends from the first pinch disc 215 such that a pinch portion 217 of the first pinch member 216 can be placed against one side of the first compressible portion 132. The first pinch solenoid 212 is preferably configured for moving the first pinch member axle 214 in the axial direction to position the first pinch member 216 in the loading and pumping position.

The first pump solenoid 202 is preferably associated with a first pump member axle 204, at the end of which is disposed the first pumping member 206. The first pumping member 206 preferably includes a substantially flat face that is configured for engaging, associating with, and compressing the side wall of the first compressible portion 132. The first pump solenoid 202 is preferably configured for moving the first pump member axle 204 in an axial direction to position the first pumping member 206 in the loading and pumping position.

In the loading position shown in FIG. 8, the first pumping member 206 and first pinch member 216 are preferably disposed to allow the first compressible portion 132 of the first conduit 144 to be received in and removed from the first pumping space 221. More preferably, the first pumping member 206 and first pinch member 216 are disposed substantially clear of the first pumping space 221 to facilitate generally unimpeded reception and removal of the first compressible portion 132 of the first conduit 144 therein and therefrom, respectively.

In the pumping position shown in FIGS. 9 and 10, the first pinch solenoid preferably moves the first pinch member 216 to block the backflow of the first fluid 40 into the first container member, as shown in FIG. 9. Preferably, the first pinch solenoid 212 moves the first pinch member axle 214 such that the first pinch member 216 is retracted through an opening 219 of the pump housing 119. Retraction of the first pinch member 216 causes the first pinch portion 217 to compress one side wall of the first compressible portion 132 against the other sidewall, thus closing the lumen thereof and preventing backflow of the first fluid therein.

The first pump solenoid 202 then preferably moves the first pump member axle 204 such that the first pumping member 206 engages and compresses against one side wall of the first compressible portion 132 in the first pumping space 221. Preferably, the first pumping member 206 compresses both side walls of the first compressible portion 132 against the wall 220 of the pumping housing 119, as shown in FIG. 10, to pump the first fluid 40 through the first conduit 144. The amount that the first compressible portion 132 is compressed by the first pumping member 206 can also be varied, depending on the amount of first fluid 40 that is to be pumped. After pumping, the first pinch and pump solenoids 212,202 preferably return, respectively, the first pinch member 216 and the first pumping member 206 to the loading position to allow the first fluid 40 to flow into the first compressible portion 132 from the first container.

The pumping assembly 120 also preferably includes a controller 208 that controls the first and second pumping mechanisms. Preferably, the controller 208 receives input from the user as to the type and size of beverage desired, and controls or adjusts the pumping mechanisms accordingly to vary the amounts of first and second fluids that are dispensed. For example, the controller 208 can vary the degree to which the first pumping member 206 compresses against the first compressible portion 132 in the first pumping space 221, thus varying the amount of first fluid 40 that is pumped through the first conduit 144. Additionally, the controller 208 can vary the amount of iterations that the first pumping member 206 compresses against the first compressible portion 132. The controller 208 also advantageously enables the pinch and pumping members of the first and second pumping mechanisms to be moved to and stopped in, preferably simultaneously, the loading position.

The pumping assembly 120 can also preferably include a second pumping mechanism and associated second members that are similarly configured to the first pumping mechanism and first members previously described for pumping a second fluid from the second container member.

The term "about," as used herein, should generally be understood to refer to both numbers in a range of numerals. Moreover, all numerical ranges herein should be understood to include each whole integer within the range.

While illustrative embodiments of the invention are disclosed herein, it will be appreciated that numerous modifications and other embodiments can be devised by those skilled in the art. Features of the embodiments described herein, for example pumping different first and second fluids in varying amounts based on input from the user, can be combined, separated, interchanged, and/or rearranged to generate other embodiments. Therefore, it will be understood that the appended claims are intended to cover all such modifications and embodiments that come within the spirit and scope of the present invention.

What is claimed is:

1. A multiple-fluid sourcing assembly, comprising:

first and second container members containing first and second fluids, respectively;

first and second conduits in respective fluid communication with the first and second container members to allow the fluids to pass therethrough;

a mounting member to which the first and second containers are mounted such that the first and second conduits are disposed at a predetermined spacing from each other;

wherein the first conduit comprises a first compressible portion and a first downstream valve in the first conduit disposed downstream of the first compressible portion and configured to allow the first fluid to flow substantially only downstream of the first downstream valve, the first compressible portion being resiliently compressible such that fluid therein is forced downstream through the first downstream valve when the first compressible portion is compressed, with the first compressible portion being resiliently biased towards an uncompressed state to draw the first fluid into the first compressible portion when the first compressible portion is decompressed;

wherein the second conduit comprises a second compressible portion that is compressible to pump the second fluid therethrough from the second container member; and a pumping mechanism which comprises a pumping member disposed between the first and second compressible portions, wherein the pumping member is configured to rotatably engage the compressible portions and to alternatively compress all of the compressible portions simultaneously and then decompress all of the compressible portions simultaneously so that a consistent amount of fluid is pumped through each of the compressible portions during each compression.

2. The multiple-fluid sourcing assembly of claim 1, wherein the first and second conduits have a length of less than about 200 mm.

3. The multiple-fluid sourcing assembly of claim 1, further comprising:

a first backflow prevention member in the first conduit configured to allow the first fluid to flow substantially only out of the first container;

wherein the first compressible portion is disposed between the first backflow prevention member and the first downstream valve, and wherein when the first compressible portion is resiliently biased towards an uncompressed state to draw the first fluid thereinto, fluid is forced through the first backflow prevention member.

4. The multiple-fluid sourcing assembly of claim 3, further comprising:

a second backflow prevention member in the second conduit configured to allow the second fluid to flow substantially only downstream, out from the second container; and a second downstream valve in the second conduit disposed downstream of the second backflow prevention member and configured to allow the second fluid to flow substantially only downstream;

wherein the second compressible portion is disposed between the second backflow prevention member and the second downstream valve, the second compressible portion being resiliently compressible such that fluid therein is forced downstream through the second downstream valve when the second compressible portion is compressed, the second compressible portion being resiliently biased towards an uncompressed state to draw the second fluid thereinto through the first backflow prevention member when the second compressible portion is decompressed.

5. The multiple-fluid sourcing assembly of claim 4, wherein the first and second backflow prevention members comprise, respectively, first and second upstream valves.

6. The multiple-fluid sourcing assembly of claim 1, wherein the first and second conduits are free of any upstream valve disposed respectively therein, between the first container and the first compressible portion or between the second container and the second compressible portion.

7. The multiple-fluid sourcing assembly of claim 5, wherein the spacing between the first and second conduits is selected to enable a single pumping member of the pumping mechanism to concurrently pump both the first and second fluids by compressing the first and second compressible portions.

8. The multiple-fluid sourcing assembly of claim 1, wherein the first and second conduits are positioned substantially parallel to each other to leave a spacing of predetermined value.

9. The multiple-fluid sourcing assembly of claim 1, wherein the conduits comprise flexible tubing and wherein the fluids are food products.

10. The multiple-fluid sourcing assembly of claim 1, wherein the mounting member comprises a housing that houses both the first and second container members.

11. The multiple-fluid sourcing assembly of claim 1, wherein the first and second container members comprise, respectively, a first and second fluid outlet members that are in fluid communication with, respectively, the first and second conduits.

12. The multiple-fluid sourcing assembly of claim 11, wherein the mounting member comprises a rigid plate member that connects the first outlet member and the second outlet member, the rigid plate member being for maintaining a predetermined spacing between the conduits.

13. A dispensing system, comprising:

a multiple-fluid sourcing assembly comprising:

first and second container members containing first and second fluids, respectively;

first and second conduits in respective fluid communication with the first and second container members to allow the fluids to pass therethrough;

a mounting member to which the first and second containers are mounted such that the first and second conduits are disposed at a predetermined spacing from each other;

a first backflow prevention member in the first conduit configured to allow the first fluid to flow substantially only out of the first container;

a second backflow prevention member in the second conduit configured to allow the second fluid to flow substantially only downstream, out from the second container;

a second downstream valve in the second conduit disposed downstream of the second backflow prevention member and configured to allow the second fluid to flow substantially only downstream; and a pumping mechanism which comprises a pumping member disposed between the first and second compressible portions, wherein the pumping member is configured to rotatably engage the compressible portions and to alternatively compress all of the compressible portions simultaneously and then decompress all of the compressible portions simultaneously so that a consistent amount of fluid is pumped through each of the compressible portions during each compression wherein the first conduit comprises a first compressible portion and a first downstream valve in the first conduit disposed downstream of the first compressible portion and configured to allow the first fluid to flow substantially only downstream of the first downstream valve, the first compressible portion being resiliently compressible such that fluid therein is forced downstream through the first downstream valve when the first compressible portion is compressed, with the first compressible portion being resiliently biased towards an uncompressed state to draw the first fluid into the first compressible portion when the first compressible portion is decompressed;

wherein the second conduit comprises a second compressible portion that is compressible to pump the second fluid therethrough from the second container member;

wherein the first compressible portion is disposed between the first backflow prevention member and the first downstream valve;

wherein when the first compressible portion is resiliently biased towards an uncompressed state to draw the first fluid thereinto, fluid is forced through the first backflow prevention member;

wherein the second compressible portion is disposed between the second backflow prevention member and the second downstream valve, the second compressible portion being resiliently compressible such that fluid therein is forced downstream through the second downstream valve when the second compressible portion is compressed, the second compressible portion being resiliently biased towards an uncompressed state to draw the second fluid thereinto through the first backflow prevention member when the second compressible portion is decompressed; and wherein the first and second backflow prevention members comprise, respectively, first and second pinch members configured to pinch the first and second compressible portions to substantially block the backflow of the first and second fluids upstream of the compressible portions.

14. The dispensing system of claim 13, further comprising a conduit guide configured for guiding the conduits for placement of the compressible portions in pumpable association with the pumping mechanism.

15. The dispensing system of claim 14, wherein the conduit guide defines an upstream opening configured to facilitate reception therein of the conduits which is larger than at least a portion of the conduit guide disposed downstream of the upstream opening to position the conduits in the pumpable association.

16. The dispensing system of claim 13, further comprising first and second compression members disposed adjacent the pumping member to define first and second pumping spaces between the pumping member and the compression members, wherein the first and second compressible portions are placed in the first and second pumping spaces, respectively, in the pumpable association, the pumping member being configured to compress the compressible portions against the compression members to pump the first and second fluids from the container members.

17. The dispensing system of claim 16, wherein the compressible members and pumping member are movable relative to each other to change the size of the pumping spaces.

18. The dispensing system of claim 16, further comprising a pump-member control configured for stopping the pumping member in a stopped position to maintain a sufficient clearance in the pumping spaces for generally unimpeded reception of the fluid conduits therein.

19. The dispensing system of claim 13, wherein the dispensing system is a beverage dispenser, and the first and second fluid sources are beverage components, the dispenser being configured for mixing the components to prepare and dispense a beverage.

20. The dispensing system of claim 19, further comprising a fluid mixing collector placed below the beverage components to receive the components and mix the components.

21. A multiple-fluid sourcing assembly, comprising:

two container members, with a first container member containing a first fluid and a second container member containing a second fluid;

first and second conduits in respective fluid communication with the first and second container members to allow the fluids to pass therethrough;

a mounting member to which the first and second containers are mounted such that the first and second conduits are disposed at a predetermined spacing from each other;

wherein the first conduit comprises a first compression member and a first downstream valve in the first conduit disposed downstream of the first compression member and configured to allow the first fluid to flow substantially only downstream of the first downstream valve, the first compression member being resiliently compressible such that fluid therein is forced downstream through the first downstream valve when the first compression member is compressed, with the first compression member being resiliently biased towards an uncompressed state to draw the first fluid into the first compression member when the first compression member is decompressed;

the second conduit comprises a second compression member that is compressible to pump the second fluid therethrough from the second container member; and a pump mechanism comprising a pumping member disposed between the two conduits and compression members to define first and second pumping spaces therebetween, the pumping member being rotatable to alternatingly compress both compression members simultaneously and then decompress both compression members simultaneously so that a consistent amount of fluid is pumped through both conduits and compression members during each compression.

22. The multiple-fluid sourcing assembly of claim 21, wherein the first and second compression members are disposed substantially on opposite sides of the pumping member.

23. The multiple-fluid sourcing assembly of claim 21, further comprising a conduit guide that defines an upstream opening configured to facilitate reception therein of the conduits, which is larger than at least a portion of the conduit guide disposed downstream of the upstream opening to guide and position the conduits in the pumping spaces.

24. The multi-fluid sourcing assembly of claim 21 wherein the fluid that is dispensed from the first conduit can be varied independently from the fluid that is dispensed from the second conduit by separately moving each compression member in or out of its respective pumping space.

25. The multi-fluid sourcing assembly of claim 1, wherein the fluid that is dispensed from the first conduit can be varied independently from the fluid that is dispensed from the second conduit by independently moving the compression members.

* * * * *

UNITED STATES PATENT AND TRADEMARK OFFICE

CERTIFICATE OF CORRECTION

PATENT NO. : 7,651,010 B2
APPLICATION NO. : 11/232962
DATED : January 26, 2010
INVENTOR(S) : Orzech et al.

It is certified that error appears in the above-identified patent and that said Letters Patent is hereby corrected as shown below:

Title Page:
Item (75) Inventors, after "Richard L. Murphy," change "Monbrelloz" to -- Montbrelloz --.

Signed and Sealed this

Sixteenth Day of March, 2010

David J. Kappos

David J. Kappos
*Director of the United States Patent and Trademark Office*